US008833711B2

(12) United States Patent
Fritz

(10) Patent No.: US 8,833,711 B2
(45) Date of Patent: Sep. 16, 2014

(54) TWO POST RACK WITH FLOOR MOUNTING BRACKETS

(75) Inventor: Robert L. Fritz, Elwood, IL (US)

(73) Assignee: Panduit Corp., Tinley Park, IL (US)

( * ) Notice: Subject to any disclaimer, the term of this patent is extended or adjusted under 35 U.S.C. 154(b) by 225 days.

(21) Appl. No.: 13/090,846

(22) Filed: Apr. 20, 2011

(65) Prior Publication Data

US 2011/0260018 A1 Oct. 27, 2011

Related U.S. Application Data

(60) Provisional application No. 61/328,229, filed on Apr. 27, 2010.

(51) Int. Cl.

| | |
|---|---|
| ***F16M 11/00*** | (2006.01) |
| ***A47F 7/00*** | (2006.01) |
| ***A47G 29/00*** | (2006.01) |
| ***A47B 95/00*** | (2006.01) |

(52) U.S. Cl.

CPC ..... *A47B 95/00* (2013.01); *Y10S 248/916* (2013.01)

USPC ..... 248/201; 248/300; 248/126; 248/218.4; 248/219.1; 248/220.1; 248/220.21; 248/224.8; 248/916; 211/26; 211/26.2; 211/189; 211/182; 211/191; 211/175; 211/195; 211/202; 312/265.1; 312/265.2; 312/265.3; 312/265.4; 312/265.5; 312/265.6; 312/223.1; 312/223.2; 312/223.3

(58) Field of Classification Search

USPC ..... 248/201, 300, 126, 218.4, 219.1, 220.1, 248/220.21, 224.8, 916; 211/26, 26.2, 189, 211/182, 191, 175, 190, 195, 202; 29/40.11, 402.8; 312/265.1–265.6, 312/223.1–223.3

See application file for complete search history.

(56) References Cited

U.S. PATENT DOCUMENTS

| | | | | |
|---|---|---|---|---|
| 5,192,046 | A | 3/1993 | Howard | |
| 5,456,433 | A * | 10/1995 | Burns et al. | 248/148 |
| 5,566,836 | A * | 10/1996 | Lerman | 211/26 |
| 6,053,281 | A * | 4/2000 | Murray | 182/113 |
| 6,065,724 | A | 5/2000 | Arslan et al. | |
| 6,202,570 | B1 * | 3/2001 | Kurtsman | 108/108 |
| 6,223,908 | B1 * | 5/2001 | Kurtsman | 211/26 |
| 6,349,837 | B1 * | 2/2002 | Serban | 211/26 |
| 6,655,533 | B2 * | 12/2003 | Guebre-Tsadik | 211/26 |
| 7,097,147 | B2 * | 8/2006 | Shaw et al. | 249/208 |
| 7,219,809 | B2 * | 5/2007 | Schluter et al. | 211/189 |

(Continued)

OTHER PUBLICATIONS

Panduit Modular NetFrame® Rack and Accessories Instructions, 4 pages, 2010.

(Continued)

*Primary Examiner* — Christopher Garft

(74) *Attorney, Agent, or Firm* — Christopher S. Clancy; James H. Williams

(57) ABSTRACT

A bracket assembly for mounting a rack to a floor includes a bracket. The bracket includes a rack-mounting surface having at least one pair of rack-mounting openings for mounting the bracket to the rack, and a floor-mounting surface extending from the rack-mounting surface. The floor-mounting surface has at least three pairs of floor-mounting openings for mounting the bracket to the floor.

12 Claims, 6 Drawing Sheets

(56) References Cited

U.S. PATENT DOCUMENTS

| | | | | |
|---|---|---|---|---|
| 7,591,056 | B2 | 9/2009 | Mimlitch, III et al. | |
| 8,042,777 | B2 * | 10/2011 | Ruiz et al. | 248/235 |
| 2002/0046979 | A1 * | 4/2002 | Larsen et al. | 211/26 |
| 2002/0100847 | A1 | 8/2002 | Lopez | |
| 2002/0104942 | A1 * | 8/2002 | Mimlitch et al. | 248/300 |
| 2003/0062326 | A1 * | 4/2003 | Guebre-Tsadik | 211/26 |
| 2005/0006324 | A1 * | 1/2005 | Richards et al. | 211/26 |
| 2006/0213853 | A1 * | 9/2006 | Schluter et al. | 211/189 |
| 2009/0040692 | A1 | 2/2009 | Barringer et al. | |
| 2010/0000950 | A1 | 1/2010 | Malekmadani | |
| 2012/0175321 | A1 * | 7/2012 | Ditges et al. | 211/26 |

OTHER PUBLICATIONS

Panduit Cable Management Standard Rack Instructions, 1 page, 2010.

Ortronics Mighty Mo® 6 Cable Management System Brochure, 5 pages, Jun. 2006.

Chatsworth Products, Inc.'s Standard Rack Product Data Sheet, 2 pages, 2010.

Tripp-Lite Anti-Tip Stabilizing Plate Kit Brochure, 2 pages, 2010.

Tripp-Lite 2-Post SmartRack Open Frame Rack Brochure, 3 pages 2010.

* cited by examiner

TWO POST RACK WITH FLOOR MOUNTING BRACKETS

CROSS-REFERENCE TO RELATED APPLICATIONS

This Utility Application claims priority to U.S. Provisional Patent Application Ser. No. 61/328,229 filed Apr. 27, 2010, entitled "Two Post Rack With Floor Mounting Brackets", which is hereby incorporated by reference in its entirety.

FIELD OF THE INVENTION

This disclosure relates to a floor mounting bracket for a two post rack which mounts electronic equipment. More specifically, the disclosure relates to a floor mounting bracket that provides multiple mounting options for high density switch applications.

BACKGROUND OF THE INVENTION

Typical two post racks for mounting electronic equipment have only one floor mounting option. For example, Panduit's CMR19X84 and NFR84 two post racks each have bracket holes which provide for only one floor mounting option. These prior mounting brackets cannot be used with 3 inch and 6 inch deep two post racks, without creating additional holes in the floor surface. Also, these prior mounting brackets do not provide the most rigid installation for two post racks.

A floor mounting bracket having multiple floor mounting options is needed to provide rack mounting flexibility, as well as to provide a more rigid rack installation.

SUMMARY OF THE INVENTION

In one aspect of the invention, a bracket assembly for mounting a rack to a floor includes a bracket. The bracket comprises a rack-mounting surface having at least one pair of rack-mounting openings for mounting the bracket to the rack, and a floor-mounting surface extending from the rack-mounting surface. The floor-mounting surface has at least three pairs of floor-mounting openings for mounting the bracket to the floor.

In another aspect of the invention, a method is provided for replacing a rack for supporting electrical equipment. A first rack, having a first width, is removed from a floor by removing first bolts extending between floor-mounting openings in the first rack and holes in the floor. A second rack, having a second width different than the first width, is installed to the floor by inserting the first bolts or second bolts through pre-manufactured floor-mounting openings in the second rack into the holes in the floor.

DETAILED DESCRIPTION OF THE INVENTION

Figure 1:
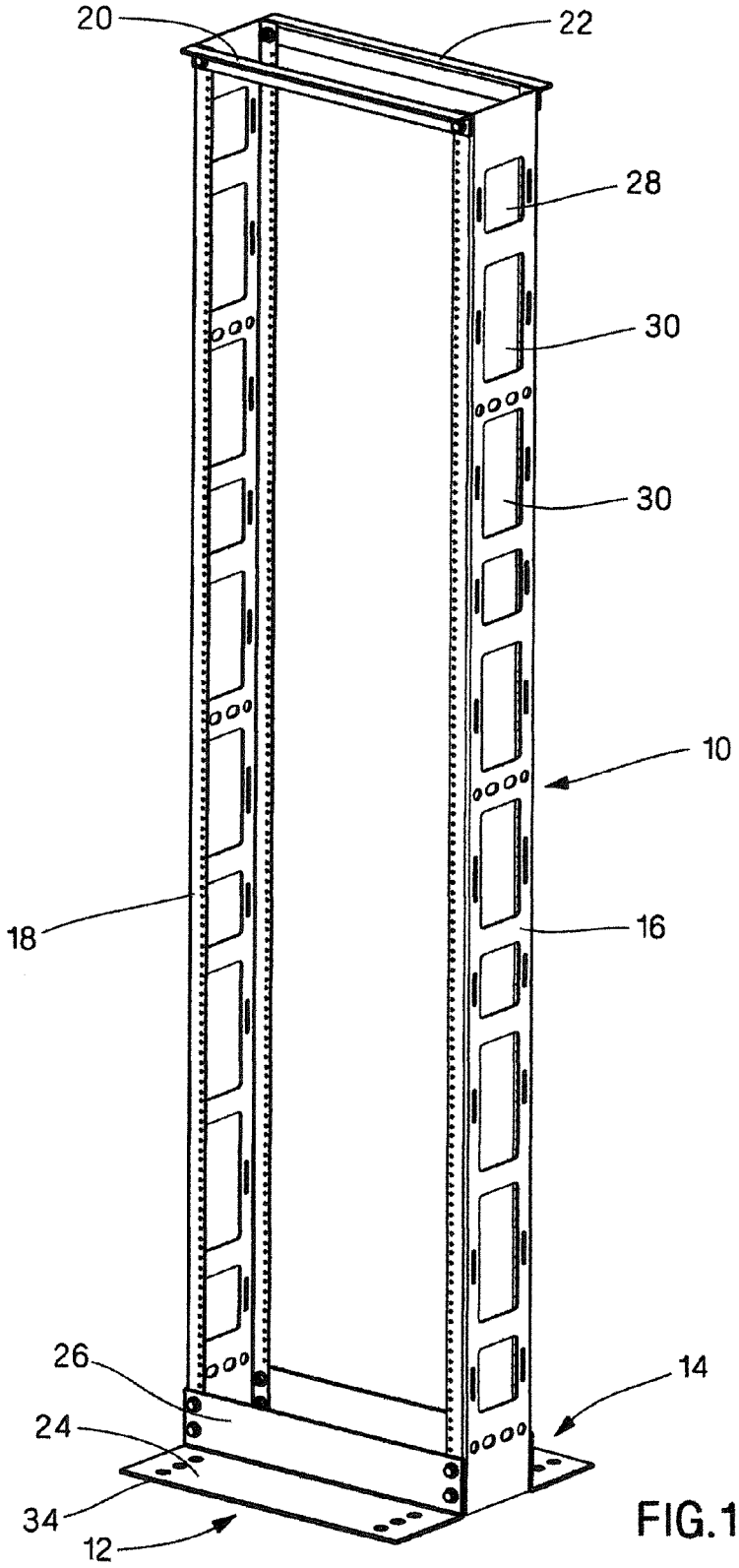
FIG. 1 illustrates a front perspective view of a two post 6 inch deep rack having a floor mounting bracket according to the present invention.

FIG. 1 illustrates a front perspective view of a two post 6 inch deep rack 10. Rack 10 includes two L-shaped brackets 12 and 14, two uprights 16 and 18, and two crossbars 20 and 22. Each of brackets 12 and 14 has a supporting surface 24 integrally attached perpendicularly to an attachment surface 26. Brackets 12 and 14 are removably attached to uprights 16 and 18. Similarly, crossbars 20 and 22 are removably attached to uprights 16 and 18. Uprights 16 and 18 are each U-shaped. A plurality of vent openings 28 and 30 extend vertically along each of uprights 16 and 18. Preferably, vent openings 28 are generally square-shaped and vent openings 30 are generally rectangular-shaped. Vent openings 28 and 30 aid in maximizing air flow and cooling of equipment installed in rack 10, especially when high density switches are utilized.

Figure 2:
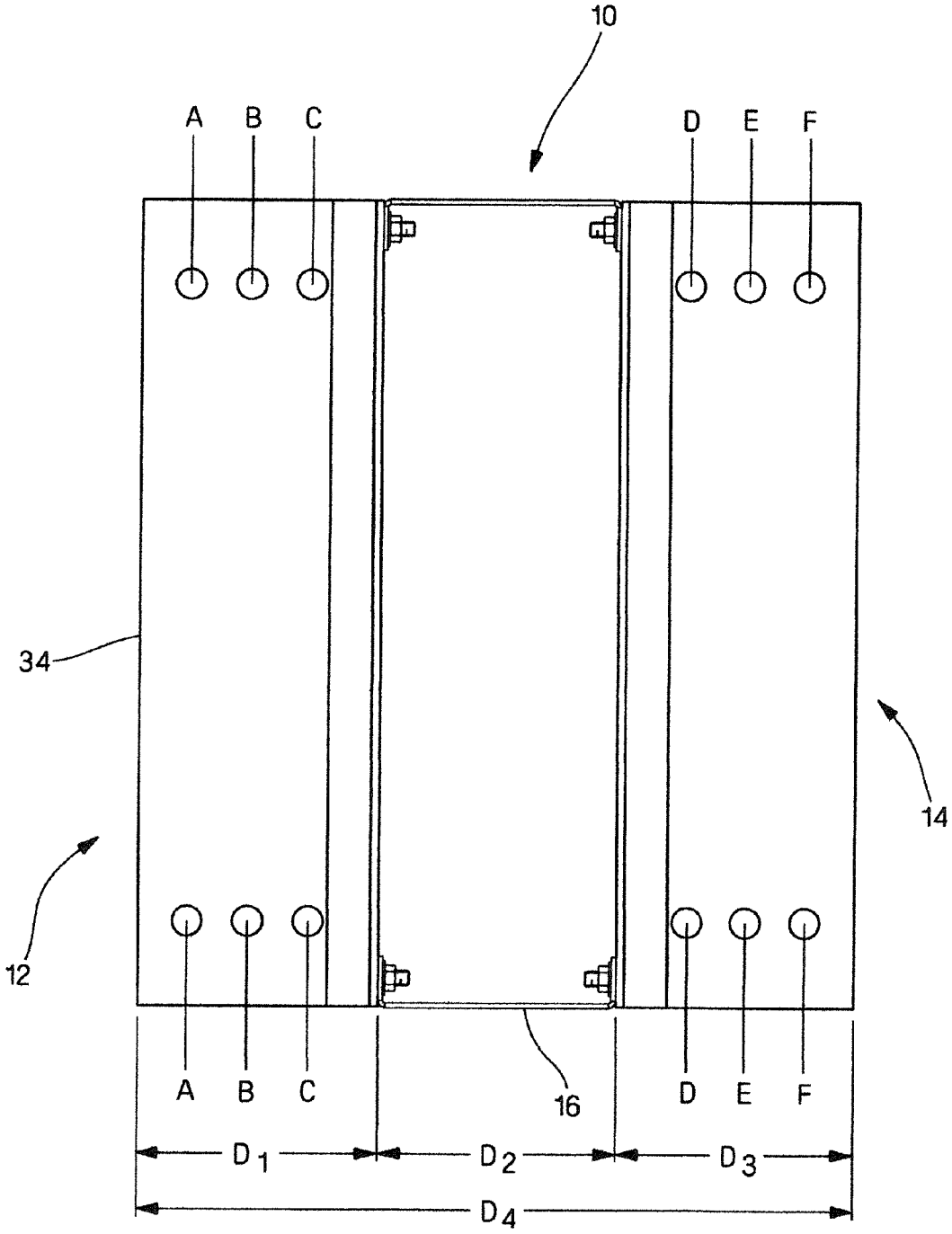
FIG. 2 illustrates a top view of the rack of FIG. 1.

FIG. 2 illustrates a top view of rack 10. Bracket 12 has three pairs of holes (A-A, B-B and C-C) to mount rack 10 to the floor. Similarly, bracket 14 has three pairs of holes (D-D, E-E and F-F) to mount rack 10 to the floor. Bracket 12 has a depth D1 of 6.0 inches, upright 16 has a depth D2 of 6.0 inches and bracket 14 has a depth D3 of 6.0 inches. Thus, the overall depth D4 of rack 10 is 18.0 inches. Holes A-A are spaced 1.25 inches from end 34 of bracket 12, and holes A-A are spaced 1.5 inches from holes B-B. Holes B-B are spaced 1.5 inches from holes C-C, and holes C-C are spaced 1.75 inches from upright 16.

Figure 3:
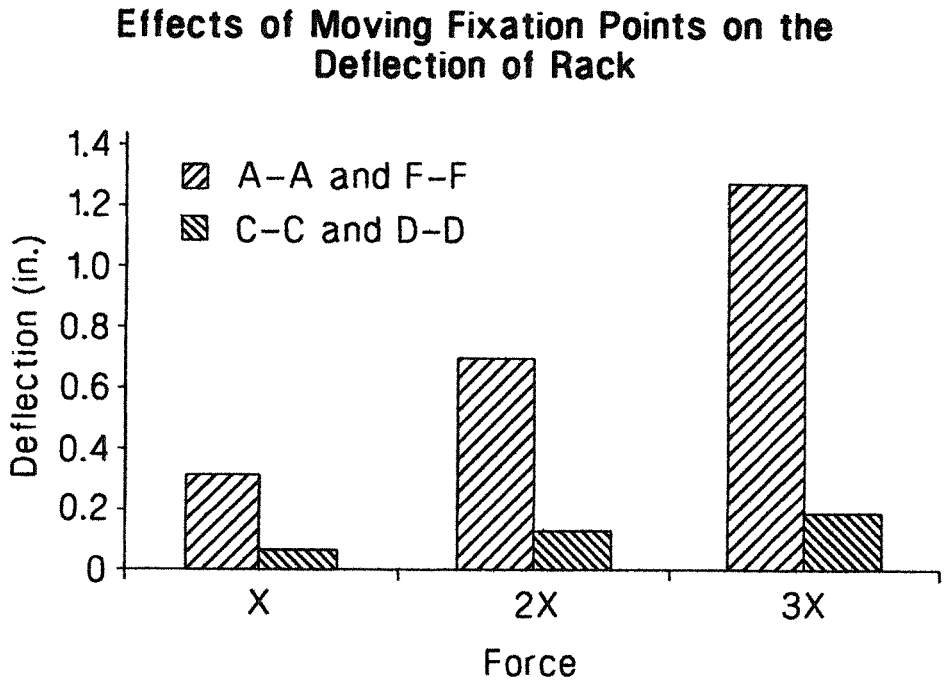
FIG. 3 illustrates a graph comparing the deflections for various loads applied to the rack of FIG. 1 at two different mounting locations.

FIG. 3 illustrates a graph comparing the deflections for various loads applied to rack 10 at two different mounting locations. Specifically, the graph compares deflections using hole patterns A-A and F-F, positioned 15.5 inches apart, and deflections using hole patterns C-C and D-D, positioned 9.5 inches apart. As shown in FIG. 3, forces of x, 2x, and 3x were applied to the center of the top of rack 10 with the mounting bolts in hole patterns A-A and F-F, and the deflections at the top of rack 10 were recorded in inches for each of these forces. The same forces were then applied to the center of the top of rack 10 with the mounting bolts in hole patterns C-C and D-D, and the deflections of rack 10 were recorded in inches for each of these forces. Depending on the amount of force applied, there was in a range of four to six times the amount of deflection of rack 10 when holes patterns A-A and F-F were used versus the amount of deflection of rack 10 when hole patterns C-C and D-D were used. Thus, a rack with a smaller mounting footprint results in a more rigid installation. For brackets 12 and 14, hole patterns C-C and D-D provide the most rigid installation.

Figure 4:
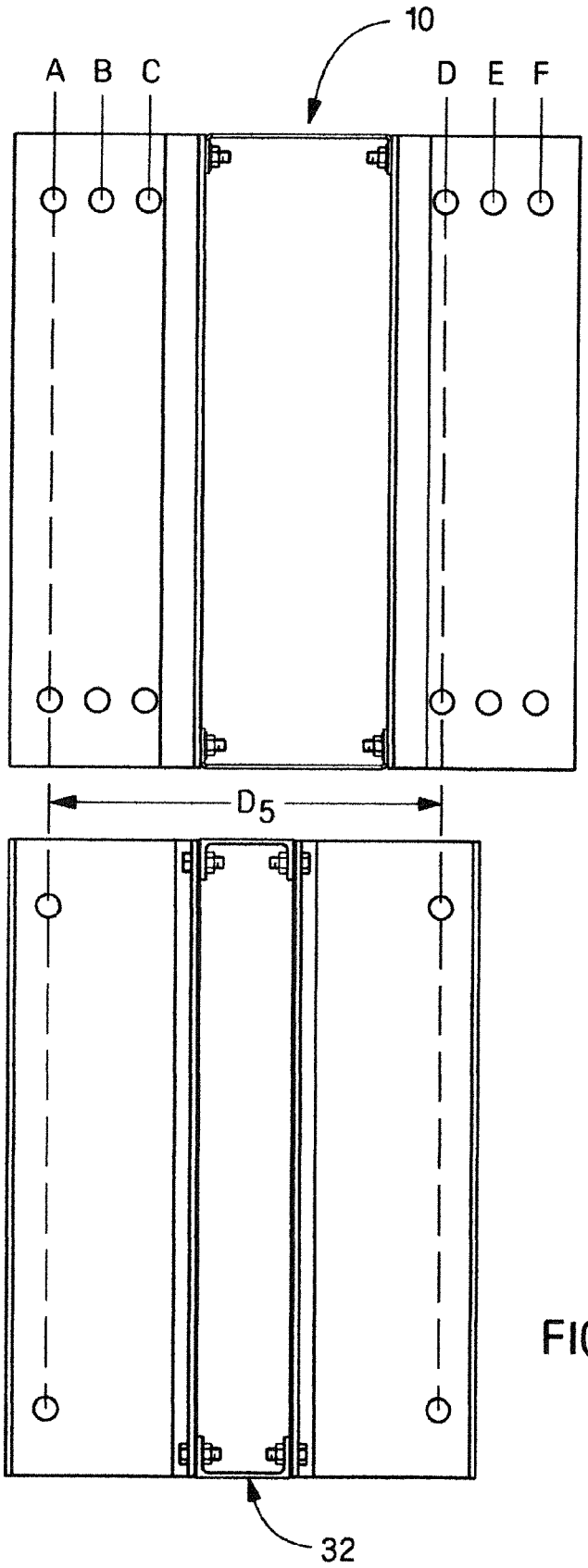
FIG. 4 illustrates a top view of the rack of FIG. 1 positioned adjacent a two post 3 inch deep rack with coplanar front faces.
Figure 5:
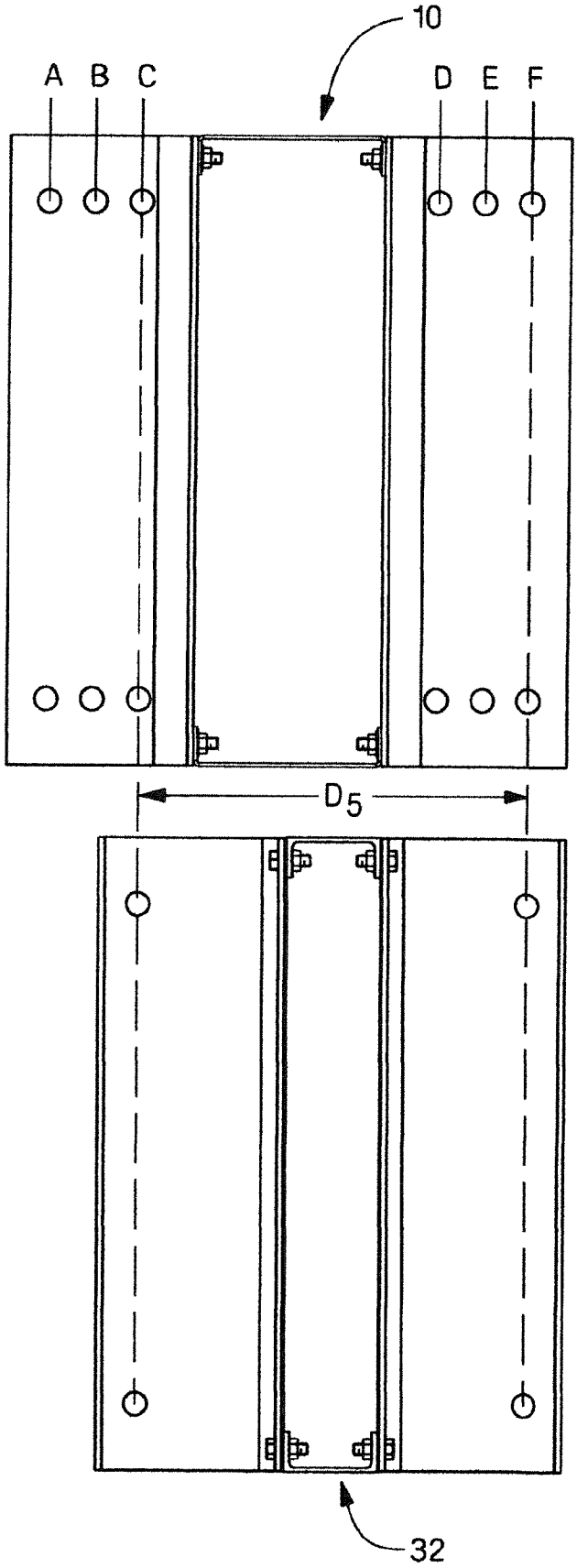
FIG. 5 illustrates a top view of the rack of FIG. 1 positioned adjacent a two post 3 inch deep rack with coplanar back faces.
Figure 6:
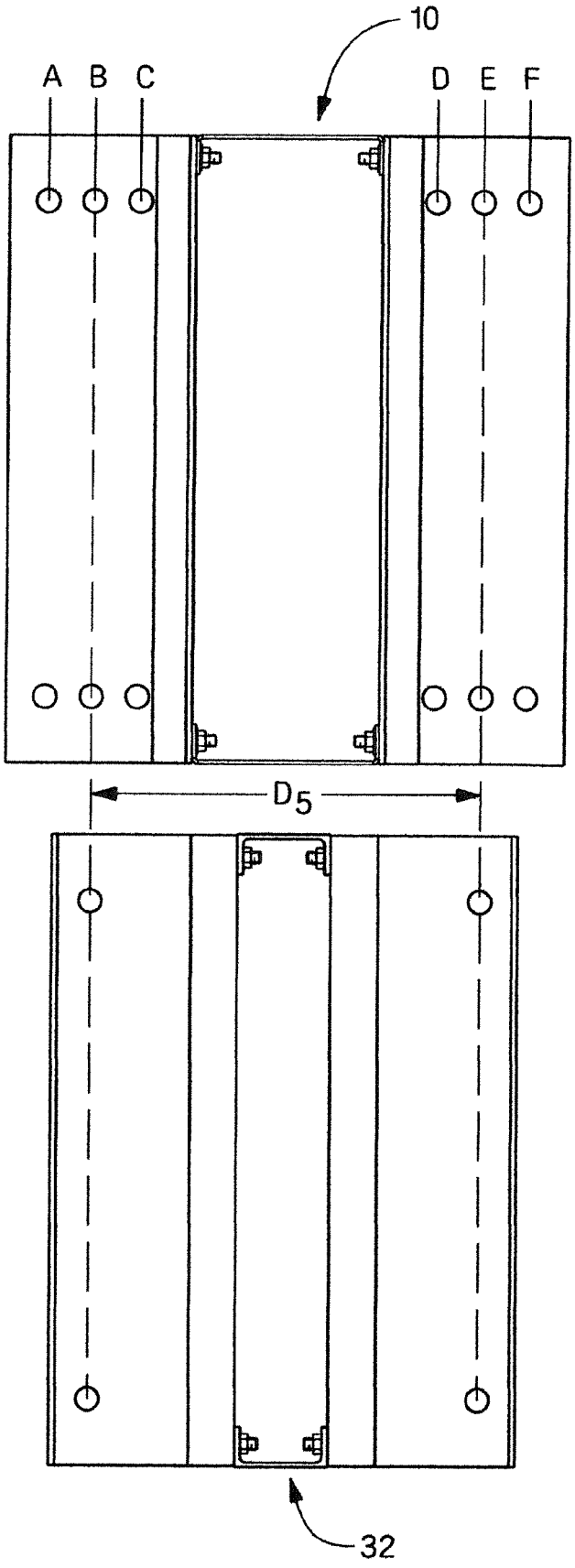
FIG. 6 illustrates a top view of the rack of FIG. 1 positioned adjacent a two post 3 inch deep rack on the same center line.

As best seen in FIG. 4, 3 inch deep two post racks, such as rack 32, are typically installed with mounting bolts 12.5 inches apart (D5). Distance D5 corresponds to the distance between holes A-A and D-D on rack 10. Also, as shown in FIG. 5, distance D5 corresponds to the distance between holes C-C and F-F on rack 10. Likewise, as shown in FIG. 6, distance D5 corresponds to the distance between holes B-B and E-E on rack 10. Thus, there are three 12.5 inch hole patterns that can be utilized in brackets 12 and 14, which provides the ability to customize for a particular installation. For example, brackets 12 and 14 allow a customer to upgrade from rack 32 to rack 10, without having to create additional holes in the floor surface.

As best seen in FIG. 4, utilizing hole patterns A-A and D-D results in the front faces of rack 10 and rack 32 being coplanar. When upgrading from rack 32 to rack 10, this mounting configuration allows equipment installed in rack 32 to be installed in the same location in rack 10, which significantly reduces the need to disturb any cabling, and eliminates the need to create additional holes in the floor surface. This mounting configuration will also provide a clean, flush appearance if rack 10 is installed in an aisle of racks 32.

As best seen in FIG. 5, utilizing hole patterns C-C and F-F results in the back faces of rack 10 and rack 32 being coplanar. Rack 32 can be replaced by rack 10, without the need to create additional holes in the floor surface.

As best seen in FIG. 6, utilizing hole patterns B-B and E-E results in the centers of rack 10 and rack 32 being aligned. This mounting configuration is desirable when rack equipment is removed when upgrading from rack 32 to rack 10, but other items, such as floor cut-outs or overhead ladder racking, remain in place.

Brackets 12 and 14 provide more floor mounting options than prior mounting brackets for two post racks. Hole patterns A-A thru F-F allow the front faces, back faces or centers of racks 10 and 32 to be aligned. The hole patterns also allow rack 32 to be replaced by rack 10, using the existing holes in the floor surface. The hole patterns further allow for the most rigid installation of rack 10.

It should be understood, of course, that the foregoing relates to exemplary embodiments of the disclosure and modifications may be made without departing from the spirit and scope of the disclosure.

I claim:

1. An assembly for mounting to four preformed holes in a floor comprising:

a first rack comprising a pair of uprights, each said upright having an upper end and a lower end and a predetermined width, a first bracket attached to said lower ends of said uprights, and a second bracket attached to said lower ends of said uprights, said brackets and said uprights defining a predetermined width of said first rack, each said bracket including a rack-mounting surface attached to the uprights, and a floor-mounting surface extending from the rack mounting surface, the floor-mounting surface of each said bracket having first, second and third pairs of spaced-apart floor-mounting openings, each said pair of floor-mounting openings being capable of receiving associated members therethrough for mounting the respective bracket to the floor, wherein a first distance is defined between said third pair of floor-mounting openings in said first bracket and said first pair of floor-mounting openings in said second bracket, a second distance is defined between said second pair of floor-mounting openings in said first bracket and said second pair of floor-mounting openings in said second bracket, and a third distance is defined between said first pair of floor-mounting openings in said first bracket and said third pair of floor-mounting openings in said second bracket; wherein the first distance, the second distance and the third distance are identical; and a second rack comprising a pair of uprights, each said upright of said second rack having an upper end and a lower end, a first bracket attached to said lower ends of said uprights of said second rack, and a second bracket attached to said lower ends of said uprights of said second rack, said brackets of said second rack and said uprights of said second rack defining a predetermined width of said second rack, said predetermined width of said second rack being different than the predetermined width of said first rack, each said bracket of said second rack including a rack-mounting surface attached to the uprights of said second rack, and a floor-mounting surface extending from the rack mounting surface of said respective bracket of said second rack, each said floor-mounting surface of said second rack having a single pair of floor-mounting openings which are capable of receiving associated members therethrough for mounting the respective bracket of said second rack to the floor, wherein a distance is defined between said pair of floor-mounting openings in said first bracket of said second rack and said pair of floor-mounting openings in said second bracket of said second rack, said distance defined in said second rack is equal to at least one of first, second or third distances defined in said first rack such that the first and second racks can both be attached, one at a time, to the four holes in the floor.

2. The assembly of claim 1 wherein in each said bracket of said first rack, the first pair of floor-mounting openings are disposed at opposite sides of the floor-mounting surface, the second pair of floor-mounting openings are disposed at the opposite sides of the floor-mounting surface, and the third pair of floor-mounting openings are disposed at the opposite sides of the floor-mounting surface.

3. The assembly of claim 1 wherein in each said bracket of said first rack, one of the first pair of floor-mounting openings, one of the second pair of floor-mounting openings, and one of the third pair of floor-mounting openings are linearly aligned relative to one another.

4. The assembly of claim 3 wherein in each said bracket of said first rack, the other of the first pair of floor-mounting openings, the other of the second pair of floor-mounting openings, and the other of the third pair of floor-mounting openings are linearly aligned relative to one another.

5. A method comprising:

providing a first rack comprising a pair of uprights, each said upright having an upper end and a lower end and a predetermined width, a first bracket attached to said lower ends of said uprights, and a second bracket attached to said lower ends of said uprights, said brackets and said uprights defining a predetermined width of said first rack, each said bracket including a rack-mounting surface attached to the uprights, and a floor-mounting surface extending from the rack mounting surface, the floor-mounting surface of each said bracket having first, second and third pairs of spaced-apart floor-mounting openings, each said pair of floor-mounting openings being capable of receiving associated members therethrough for mounting the respective bracket to the floor, wherein a first distance is defined between said third pair of floor-mounting openings in said first bracket and said first pair of floor-mounting openings in said second bracket, a second distance is defined between said second pair of floor-mounting openings in said first bracket and said second pair of floor-mounting openings in said second bracket, and a third distance is defined between said first pair of floor-mounting openings in said first bracket and said third pair of floor-mounting openings in said second bracket; wherein the first distance, the second distance and the third distance are identical; and providing a second rack comprising a pair of uprights, each said upright of said second rack having an upper end and a lower end, a first bracket attached to said lower ends of said uprights of said second rack, and a second bracket attached to said lower ends of said uprights of said second rack, said brackets of said second rack and said uprights of said second rack defining a predetermined width of said second rack, said predetermined width of said second rack being different than the predetermined width of said first rack, each said bracket of said second rack including a rack-mounting surface attached to the uprights of said second rack, and a floor-mounting surface extending from the rack mounting surface of said respective bracket of said second rack, each said floor-mounting surface of said second rack having a single pair of floor-mounting openings which are capable of receiving associated members therethrough for mounting the respective bracket of said second rack to the floor wherein a distance is defined between said pair of floor-mounting openings in said first bracket of said second rack and said pair of floor-mounting openings in said second bracket of said second rack, said distance defined in said second rack is equal to at least one of first, second or third distances defined in said first rack such that the first and second racks can both be attached, one at a time, to the four holes in the floor forming only four holes in a floor in preparation for attachment of the racks thereto;

installing said first rack onto said floor by placing bolts through said third pair of floor-mounting openings in said first bracket and said first pair of floor-mounting openings in said second bracket such that the other pairs of floor-mounting openings are unused;

removing said first rack from said floor by removing said bolts from said brackets in said first rack; and installing said second rack into said four holes in the floor by placing bolts through said floor-mounting openings in the second rack.

6. The method of claim 5 wherein the installing the second rack further comprises inserting the bolts through the pair of floor-mounting openings in said second rack such that a front side of the second rack is aligned with a plane where a front side of the first rack was disposed when the first rack was attached to the floor.

7. The method of claim 5 wherein the installing the second rack further comprises inserting the bolts through the pair of floor-mounting openings to align a center of the second rack with a plane where a center of the first rack was disposed when the first rack was attached to the floor.

8. The method of claim 5 wherein the installing the second rack further comprises inserting the bolts through the pair of floor-mounting openings to align a center of the second rack to be coplanar with a center of a structure.

9. The method of claim 5 wherein the installing the second rack further comprises inserting the bolts through the pair of floor-mounting openings to align a back side of the second rack with a plane where a back side of the first rack was disposed when the first rack was attached to the floor.

10. The assembly of claim 1, wherein said first pair of floor-mounting openings in said first bracket are proximate to said rack-mounting surface of said first bracket, and said first pair of floor-mounting openings in said second bracket are proximate to said rack-mounting surface of said second bracket.

11. The assembly of claim 1 wherein in each said bracket of said first rack, the first pair of floor-mounting openings, the second pair of floor-mounting openings, and the third pair of floor-mounting openings are linearly aligned relative to one another.

12. A method of using the racks defined in claim 11, comprising:

forming only four holes in a floor in preparation for attachment of the racks thereto;

installing said first rack into said four holes in the floor by placing bolts through said third pair of floor-mounting openings in said first bracket and said first pair of floor-mounting openings in said second bracket such that the other pairs of floor-mounting openings are unused;

removing said first rack from said floor by removing first said bolts from said brackets in said first rack; and installing said second rack into said four holes in the floor by placing bolts through said floor-mounting openings in the second rack.

* * * * *